United States Patent [19]

Frankland

[11] 4,302,756

[45] Nov. 24, 1981

[54] MULTIPLEXED DISPLAY SYSTEM

[75] Inventor: Roger A. Frankland, Scottsdale, Ariz.

[73] Assignee: Beckman Instruments, Inc., Fullerton, Calif.

[21] Appl. No.: 98,579

[22] Filed: Nov. 29, 1979

[51] Int. Cl.[3] ..... G09F 9/32

[52] U.S. Cl. ..... 340/802; 340/713; 340/753; 340/776

[58] Field of Search ..... 340/776, 802, 753, 754, 340/713, 773, 759

[56] References Cited

U.S. PATENT DOCUMENTS 3,719,940 3/1973 Lay et al. ..... 340/776

*Primary Examiner*—Marshall M. Curtis

*Attorney, Agent, or Firm*—R. J. Steinmeyer; F. L. Mehlhoff; William H. May

[57] ABSTRACT

A multiplexed display system which prevents closely positioned electrodes from causing erroneous displays. The electrodes are divided into selectively enabled groups. The electrodes are connected to switching circuits in a pattern such that the first one or more electrodes in each group are not connected to the same switching circuits as any of the electrodes in the preceding group, and the last one or more electrodes in each group are not connected to the same switching circuits as any of the electrodes in the next succeeding group.

16 Claims, 7 Drawing Figures

V+
60
70
1
2
3
4
10
20
30
40
11 12 13 14 15 16 17 18
21 22 23 24 25 26 27 28
31 32 33 34 35 36 37 38
41 42 43 44 45 46 47 48
101 102 103 104 105 106
107 108 109 110
I
II
III
IV
V−

MULTIPLEXED DISPLAY SYSTEM

BACKGROUND OF THE INVENTION

The present invention broadly relates to display systems which employ multiplexing to reduce the number of switching circuits required to control the electrodes in the display device. More specifically, the invention relates to techniques for preventing interactions among closely positioned electrodes from causing erroneous displays.

In the present discussion, the term "display device" shall refer to a device which converts electrical signals into visual representations, and the term "display system" shall refer to a combination including both a display device and electrical circuitry which operates the display device by applying signals thereto.

Many display devices employ an array of symbols in such shapes as dots, rectangles or line segments to display a variety of numerals, letters, arrows, bar graphs or other characters by simultaneously displaying symbols which in combination describe the shape of the character to be displayed.

Such display devices generally include an array of electrodes, one electrode for each symbol, whereby a symbol is displayed by applying a signal to the electrode corresponding to that symbol. An electrode may be said to be activated when a signal is applied so as to display a symbol, and a signal which activates an electrode shall be referred to herein as an activating signal.

The electrical circuitry which operates the display device generally includes an array of switching circuits for selectively activating the electrodes in the display device. To permit displaying various combinations of symbols, a separate switching circuit is required for each electrode so that each electrode can be controlled independently of the others.

Multiplexing is a commonly used technique for reducing the number of switching circuits required to control each electrode independently. In a multiplexed display system, the electrodes in the display device are organized in groups, and the groups are associated with a means for enabling only one selected group at a time and disabling the other groups. When a group is enabled, every electrode in that group operates normally so that activating any electrode causes its corresponding symbol to be displayed. When a group is disabled, activating an electrode in that group has no effect, and none of the symbols corresponding to the electrodes in that group can be displayed.

In a multiplexed display system, each switching circuit connects simultaneously to one electrode in every group, so that each switching circuit selectively activates either all or none of the electrodes to which it is connected. Since only one group is enabled at a time, each switching circuit can display only one symbol at a time, which is the symbol whose corresponding electrode is in the one enabled group.

To allow any combination of symbols to be apparently displayed simultaneously, the enabling means rapidly sequences through each group to enable each group for a short period at least 60 times per second. Even though only the symbols in the one enabled group can actually be displayed at any moment in time, the sequencing from one group to the next is so rapid the sequentially displayed symbols in different groups appear to be displayed simultaneously and continuously.

A common problem with multiplexed display systems is that the enabling means generally works imperfectly. In particular, if an activated electrode is in a group that is disabled but positioned adjacent to an enabled group, the activated electrode may produce a light emission or some other erroneous display, even though its group should be disabled.

One type of display system that illustrates this problem is the type whose display devices are gas discharge display tubes. In a gas discharge display, the electrodes are cathodes and the enabling means comprises a plurality of anodes, one anode being associated with each group of cathodes. A cathode is activated by applying a certain relatively negative voltage thereto, and a group of cathodes is enabled by applying a certain relatively positive voltage to that group's anode, thereby producing a current flow from that group's anode to the activated cathodes in that group. This current flow causes the gas surrounding each activated cathode to emit light which exhibits the symbol corresponding to each activated cathode.

The problem is that current sometimes can flow from the anode of an enabled group to a nearby activated cathode in an adjacent disabled group. This can produce an undesired light emission known as positive glow or streamers, as discussed in U.S. Pat. No. 3,815,120 issued to Kanda on June 4, 1974. Prior art solutions to this problem include increasing the spacing between, or erecting barriers between, adjacent groups of cathodes, which has the disadvantage of limiting the density and compactness of the display. Prior art solutions also frequently require limiting the current through each cathode to prevent streamers, which has the disadvantage of limiting the brightness of the display.

SUMMARY OF THE INVENTION

The display system of the present invention comprises a plurality of switching circuits connected to the display device electrodes in such a way that when a particular group of electrodes is enabled, any of the electrodes in that group can be activated without activating nearby electrodes in a closely adjacent disabled group. This prevents erroneous displays from being caused by interactions between the enabled group and the nearby electrodes outside the group without requiring extra spacing or barriers around the enabled group. For example, in a multiplexed display system employing gas discharge display tubes the present invention prevents erroneous light emissions due to streamers or positive glow.

More particularly, the display system according to the present invention comprises a plurality of electrodes arranged in one or more rows, each row of electrodes being organized in groups of consecutively positioned electrodes. The display further comprises either or both of the following two features. The first feature is that in each group, except for the first group, in a row, the switching circuit connected to the first electrode in that group is not connected to any of the electrodes in the preceding group in that row. The second feature is that in each group, except for the last group, in a row, the switching circuit connected to the last electrode in that group is not connected to any of the electrodes in the next succeeding group in that row.

Some embodiments of the invention further comprise either or both of the following two features. The first feature is that in each group, except for the first group, in a row, the switching circuits connected to the first two or more consecutive electrodes in that group are not connected to any of the electrodes in the preceding group in that row. The second feature is that in each group, except for the last group, in a row, the switching circuits connected to the last two or more consecutive electrodes in that group are not connected to any of the electrodes in the next succeeding group in that row.

DESCRIPTION OF THE PREFERRED EMBODIMENTS

Figure 1:
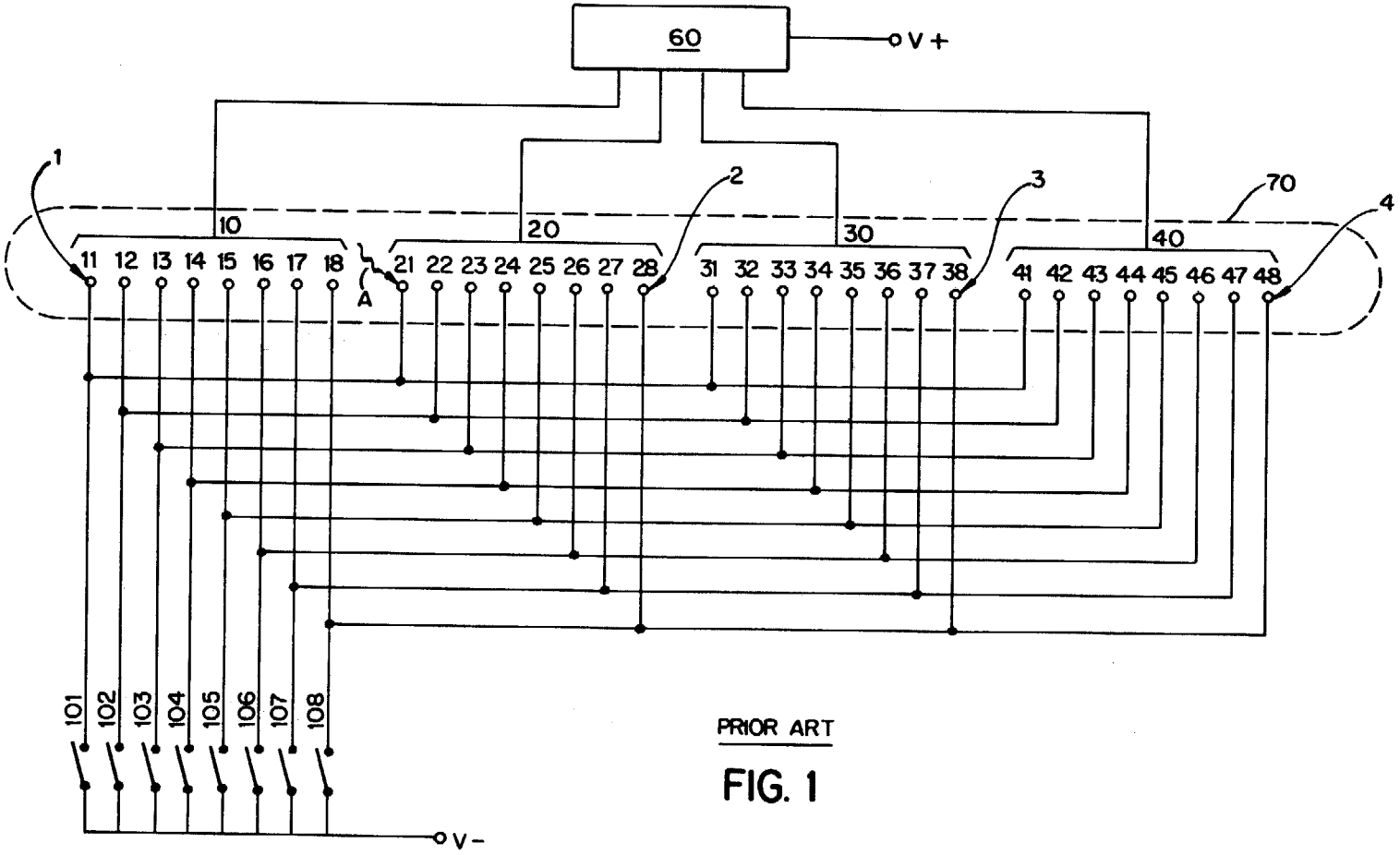
PRIOR ART FIG. 1
FIG. 1 is a schematic diagram of a prior art display system employing a gas discharge display tube.

The best way to understand the present invention is to compare a display system according to the invention with a prior art display system having the same arrangement of electrodes. FIG. 1 is a schematic diagram of a prior art display system employing a gas discharge display tube 70 as the display device. It operates the same way as the prior art display systems described in the "Background of the Invention." The display tube 70 comprises four anodes 10, 20, 30 and 40 which are associated with four groups 1, 2, 3 and 4 of cathodes consisting of cathodes 11–18, 21–28, 31–38 and 41–48, respectively. All 32 cathodes are arranged in a single horizontal row. The enabling means comprises enabling circuit 60 and the four anodes 10, 20, 30 and 40. The enabling circuit 60 rapidly sequences through each of the four anodes 10, 20, 30 and 40 by applying a relatively positive voltage V+ to each anode for a period of typically 1 millisecond each. In other words, enabling circuit 60 applies this voltage to anode 10 for 1 ms, then to anode 20 for 1 ms, then to anode 30 for 1 ms, then to anode 40 for 1 ms, then to anode 10 again for 1 ms, etc.

If, for example, it is desired to display the symbol corresponding to cathode 14, switch 104 is closed during each 1 ms time period when voltage V+ is applied to anode 10. The symbols corresponding to cathodes 24, 34 and 44 will not be displayed unless switch 104 remains closed during the time periods when voltage V+ is applied to anodes 20, 30 and 40, respectively.

Figure 2:
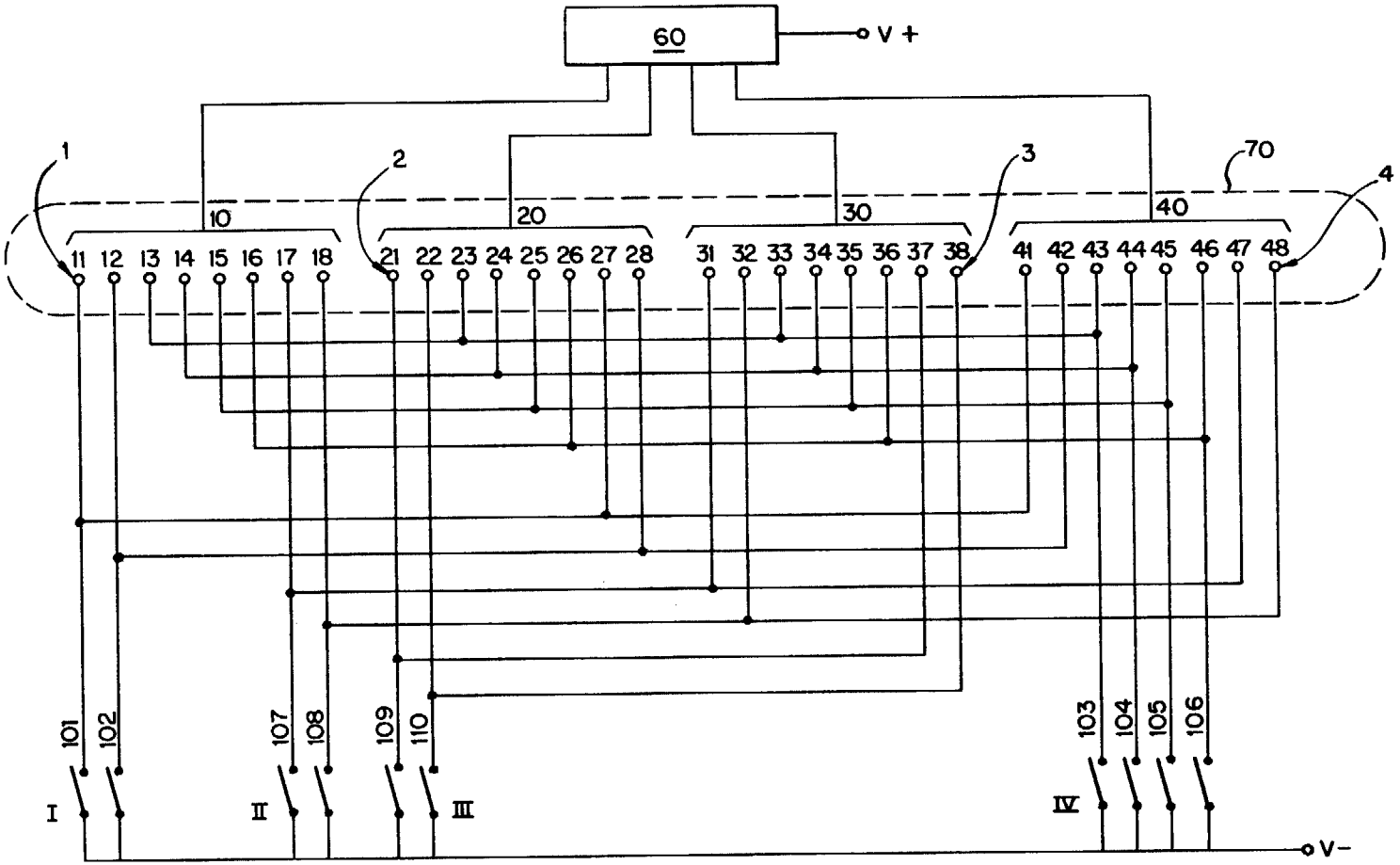
FIG. 2 is a schematic diagram of a display system according to the present invention employing the same arrangement of cathodes and anodes as the prior art display of FIG. 1.

FIG. 2 is a schematic diagram of a display system according to the present invention employing the same arrangement of cathodes and anodes and the same enabling circuit as the prior art display in FIG. 1.

The difference between the invention shown in FIG. 2 and the prior art display system shown in FIG. 1 is the increased number of switching circuits 101–110 and the way they are connected to the cathodes. In the prior art display system of FIG. 1, the number of switching circuits 101–108 equals the number of cathodes in each of the four groups 1–4; i.e., eight. Each switching circuit connects to one cathode in each group. For example, the second switching circuit 102 connects to the second cathode in each of the four groups 1, 2, 3 and 4, which are cathodes 12, 22, 32 and 42, respectively.

In the embodiment of the invention shown in FIG. 2, two additional switching circuits 109 and 110 are used, and the switching circuits are connected to the cathodes in a pattern that satisfies the following two constraints:

(1) in each group but the first group, the switching circuits connected to the first two consecutive cathodes in that group are not connected to any of the cathodes in the preceding group, and (2) in each group but the last group, the switching circuits connected to the last two consecutive cathodes in that group are not connected to any of the cathodes in the next succeeding group.

In particular, the first constraint is satisfied because switching circuits 109 and 110 connected to the first two consecutive cathodes 21 and 22 in group 2 are not connected to any of the cathodes 11–18 in the preceding group 1, switching circuits 107 and 108 connected to the first two consecutive cathodes 31 and 32 in group 3 are not connected to any of the cathodes 21–28 in the preceding group 2, and switching circuits 101 and 102 connected to the first two consecutive cathodes 41 and 42 in group 4 are not connected to any of the cathodes 31–38 in the preceding group 3.

The second constraint is satisfied because switching circuits 107 and 108 connected to the last two consecutive cathodes 17 and 18 of group 1 are not connected to any of the cathodes 21–28 in the next succeeding group 2, switching circuits 101 and 102 connected to the last two consecutive cathodes 27 and 28 in group 2 are not connected to any of the cathodes 31–39 in the next succeeding group 3, and switching circuits 109 and 110 connected to the last two consecutive cathodes 37 and 38 in group 3 are not connected to any of the cathodes 41–49 in the next succeeding group 4.

To appreciate the advantage of the invention shown in FIG. 2 over the prior art shown in FIG. 1, assume one wants to display the symbols corresponding to cathodes 11 and 13. This is accomplished by closing switches 101 and 103 to apply a relatively negative voltage V− to cathodes 11 and 13 whenever group 1 is enabled, and by opening all the switches 101–110 whenever groups 2, 3 or 4 are enabled.

In the prior art display system shown in FIG. 1, when group 1 is enabled (by applying voltage V+ to anode 10), switches 101 and 103 activate not only the desired cathodes 11 and 13, but also the undesired ones 21, 23, 31, 33, 41 and 43. Ideally, activating these six undesired cathodes should be harmless, since their respective groups 2, 3 and 4 are disabled; i.e., their associated anodes 20, 30 and 40 are not connected to voltage V+. However, cathode 21 may be close enough to anode 10 to cause a current to flow between them as represented by the arrow A in FIG. 1. This can produce an erroneous light emission known as a streamer or positive glow. Cathodes 23, 31, 33, 41 and 43 are too far from anode 10 to have this problem.

The embodiment of the invention shown in FIG. 2 prevents the occurrence of any streamers or positive glow. As in the prior art, switches 101 and 103 activate the desired cathodes 11 and 13. Switch 103 also activates undesired cathodes 23, 33 and 43, just as in the prior art, but these are far enough from anode 10 to avoid any streamers. However, unlike the prior art, switch 101 does not activate undesired cathodes 21 and 31; instead it activates undesired cathodes 27 and 41. Cathodes 27 and 41 are both far enough from anode 10 to avoid the streamer problem, in contrast with cathode 21 which caused the problem in the prior art design.

More generally, the invention eliminates the problem of streamers or positive glow because the switching circuits are connected to the cathodes in such a way that any of the cathodes in an enabled group an be activated without activating the nearby cathodes in adjacent groups. The nearby cathodes constitute a buffer zone controlled by switching circuits separate from those which control the cathodes in the enabled group.

The width of each buffer zone in the embodiment shown in FIG. 2 is two cathodes on each side of each group, but the buffer zone width may be reduced to one cathode or increased to any number of cathodes.

If we let the symbol N represent the number of cathodes in each buffer zone, the two constraints stated earlier may be expressed more generally as follows:

(1) in each group but the first group, the switching circuits connected to the first N consecutive cathodes in that group are not connected to any of the cathodes in the preceding group, and (2) in each group but the last group, the switching circuits connected to the last N consecutive cathodes in that group are not connected to any of the cathodes in the next succeeding group.

For example, the two constraints on a display system whose buffer zone width is three cathodes are the two preceding constraints, except with the word "three" substituted for "N".

An alternative way to express the same constraints without explicit reference to the symbol N is as follows:

(1) in each group but the first group, the switching circuits connected to the first one or more consecutive cathodes in that group are not connected to any of the cathodes in the preceding group, and (2) in each group but the last group, the switching circuits connected to the last one or more consecutive cathodes in that group are not connected to any of the cathodes in the next succeeding group.

There are many possible patterns of interconnection between the electrodes and the switching circuits which satisfy the two constraints. The interconnection pattern shown in FIG. 2 is an example of a type of pattern which may be generalized as follows.

Let N represent the number of cathodes in each buffer zone. The switching circuits are divided into four mutually exclusive sets of switching circuits, with the first, second and third sets each consisting of N distinct switching circuits, and with the fourth set consisting of all the remaining switching circuits. The N switching circuits in the first set (I) are connected to the first N electrodes in the first group and in every third group thereafter (i.e., to the first N electrode in each of the first, fourth, seventh, tenth, etc. groups). The N switching circuits in the first set (I) are also connected to the last N electrodes in the second group and in every third group thereafter (i.e., to the last N electrodes in each of the second, fifth, eighth, eleventh, etc. groups). The N switching circuits in the second set (II) are connected to the last N electrodes in the first group and every third group thereafter, and to the first N electrodes in the third group and every third group thereafter. The N switching circuits in the third set (III) are connected to the first N electrodes in the second group and every third group thereafter, and to the last N electrodes in the third group and every third group thereafter. The switching circuits in the fourth set (IV) are connected to the remaining electrodes, i.e., to the electrodes other than the first N and last N electrodes in each group.

For example, in the display system shown in FIG. 2, N equals two. The first set (I) of two switching circuits consists of switches 101 and 102, and they connect to the first two electrodes 11 and 12 in group 1, the first two electrodes 41 and 42 in group 4, and the last two electrodes 27 and 28 in group 2. The second set (II) consists of switches 107 and 108, and they connect to the last two electrodes 17 and 18 in group 1, the last two electrodes 47 and 48 in group 4, and the first two electrodes 31 and 32 in group 3. The third set (III) consists of switches 109 and 110, and they connect to the first two electrodes 21 and 22 in group 2 and the last two electrodes 37 and 38 in group 3. The fourth set (IV) consists of switches 103–106, and they connect to the remaining electrodes which are electrodes 13–16, 23–26, 33–36, and 43–46.

The type of pattern just discussed is only one of many possible types which satisfy the two constraints. For example, FIG. 3 shows a display system having the same arrangement of anodes, cathodes and switching circuits as the display system shown in FIG. 2, but having a substantially different interconnection pattern.

The interconnection pattern shown in FIG. 3 may be described as follows. The first switching circuit 101 connects to the first cathode and every tenth cathode thereafter, i.e., to the first cathode 11, the eleventh cathode 23, the twenty-first cathode 35, and the thirty-first cathode 47. The second switching circuit 102 connects to the second cathode and every tenth cathode thereafter, i.e., to the second cathode 12, the twelfth cathode 24, the twenty-second cathode 36, and the thirty-second cathode 48. The third switching circuit 103 connects to the third cathode and every tenth cathode thereafter, i.e., to the third cathode 13, the thirteenth cathode 25, the twenty-third cathode 37, and the thirty-third cathode 49. The fourth through tenth switching circuits 103–110 are each successively connected in a like pattern.

Figure 3:
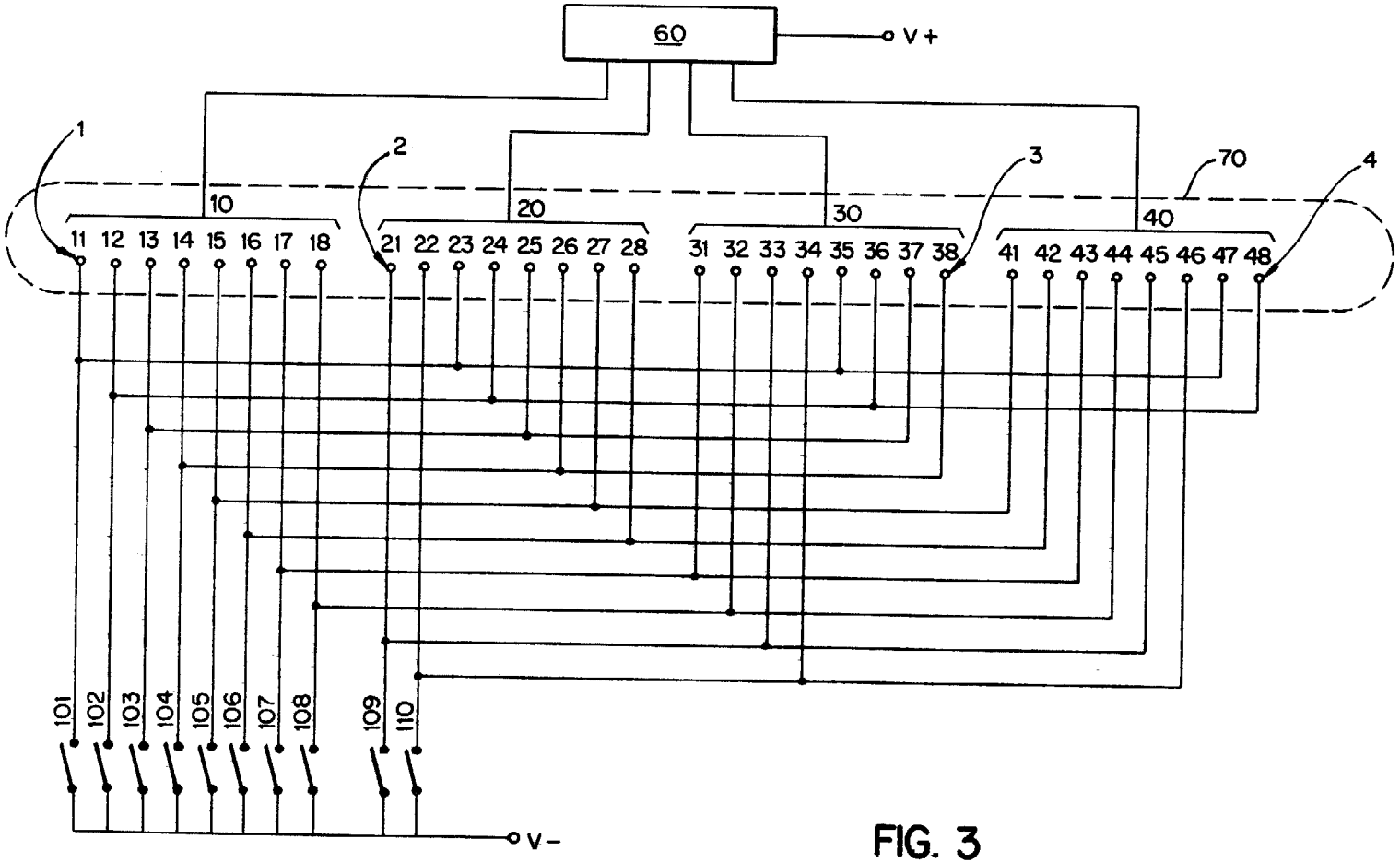
FIG. 3 is a schematic diagram of an alternative embodiment of a display system similar to that shown in FIG. 2.

The interconnection pattern shown in FIG. 3 employs ten switching circuits 101–110. The analogous pattern for a display system in which the number of switching circuits is some number M is that the first switching circuit connects to the first electrode and every M-th electrode thereafter, i.e., to the first electrode, and the (1+M)-th electrode, and the (1+2M)-th electrode, etc.; the second switching circuit connects to the second electrode and every M-th electrode thereafter, i.e., to the second electrode, and the (2+M)-th electrode, and the (2+2M)-th electrode, etc.; the third switching circuit connects to the third electrode and every M-th electrode thereafter, i.e., to the third electrode, and the (3+M)-th electrode, and the (3+2M)-th electrode, etc.; and the fourth through M-th switching circuits are each successively connected in a like pattern. Note that the pattern discussed in the preceding paragraph is obtained by letting the value of M be 10, which is the number of switching circuits in FIG. 3.

The number of switching circuits required in the invention exceeds the number required in prior art designs by the number of cathodes desired in the buffer zone. For example, the display systems of FIGS. 1, 2 and 3 have eight cathodes in each group. Prior art circuits require eight switching circuits, whereas the present invention requires nine, ten or eleven switching circuits to achieve a buffer zone width of one, two or three cathodes, respectively. To minimize the number of switching circuits required, the buffer zone width normally will be chosen as the minimum width that will prevent streamers on other undesirable interactions. A width of one or two cathodes is sufficient in most applications.

All interconnection patterns which satisfy both of the two constraints and which use the minimum number of switching circuits for a given buffer zone width (i.e., all patterns in which the number of switching circuits equals the sum of the buffer zone width plus the number of electrodes in each group) share a common characteristic. This characteristic is that the electrodes in the buffer zone adjacent to and on one side of a group will be connected to the same set of switching circuits as the electrodes in the buffer zone adjacent to and on the other side of that group. For example, in FIGS. 2 and 3, the electrodes on one side of group 2 are cathodes 17 and 18, and the electrodes on the other side are cathodes 31 and 32. Both pairs of cathodes connect to the same set of switching circuits 107 and 108.

The invention is not limited to display systems using gas discharge display tubes. The invention applies to any multiplexed display system in which each symbol is displayed by applying an appropriate signal to an electrode, not necessarily a cathode, associated with that symbol. For example, the invention applies to plasma displays and vacuum fluorescent displays. Usually, the anodes and grids within a vacuum fluorescent display tube are connected in a display system like the cathodes and anodes, respectively, of the described gas discharge display tube. The two constraints discussed earlier may be generalized by substituting the more general word "electrode" for the word "cathode" wherever it appears therein.

The invention also applies to multiplexed display systems which comprise means for selectively enabling a group of electrodes different from the means employed in the illustrated embodiment. For example, in a vacuum fluorescent display system the enabling means comprises the grids within a vacuum fluorescent display tube in place of the anodes within a gas discharge display tube.

FIGS. 1 and 2, in the interest of simplicity, represent switching circuits 101–110 with the symbols for mechanical switches. In practice, the switching circuits generally will employ electronic switches such as transistors instead of mechanical switches. Such switching circuits are well known in the art, and the invention is compatible with any type of switching circuit.

FIGS. 2 and 3 show only a single row of electrodes in the display device 70. This would be suitable in certain display applications, such as a bar graph display system. More commonly, a display system includes several rows of electrodes, such as a dot matrix display system whose symbols are a plurality of dots arranged in rows and columns in a rectangular array or matrix. A dot matrix display system according to the present invention may comprise several rows of electrodes, each row being connected to a separate set of switching circuits as if it were a separate single-row display.

Figure 4:
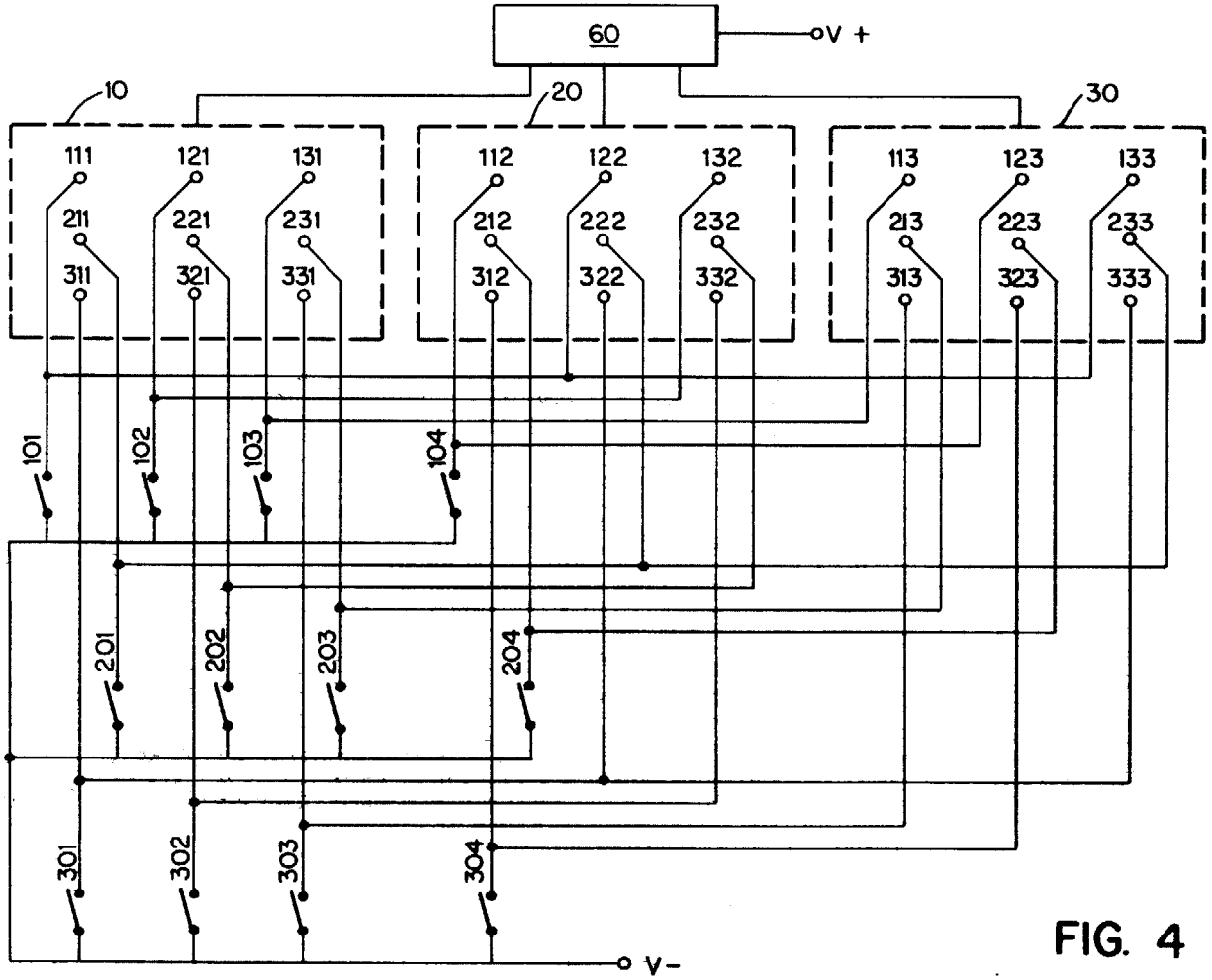
FIG. 4 is a schematic diagram of a display system having a three row by nine column array of cathodes.

FIG. 4 shows a dot matrix display system according to the above stated principles. As in the first three figures, the display system uses a gas discharge display tube. The cathodes are organized into three groups, each group being associated with one of the three anodes 10, 20 and 30. Each cathode is identified by a three-digit number; the digits designate the row, column, and group, respectively, in which that cathode is located.

Figure 5:
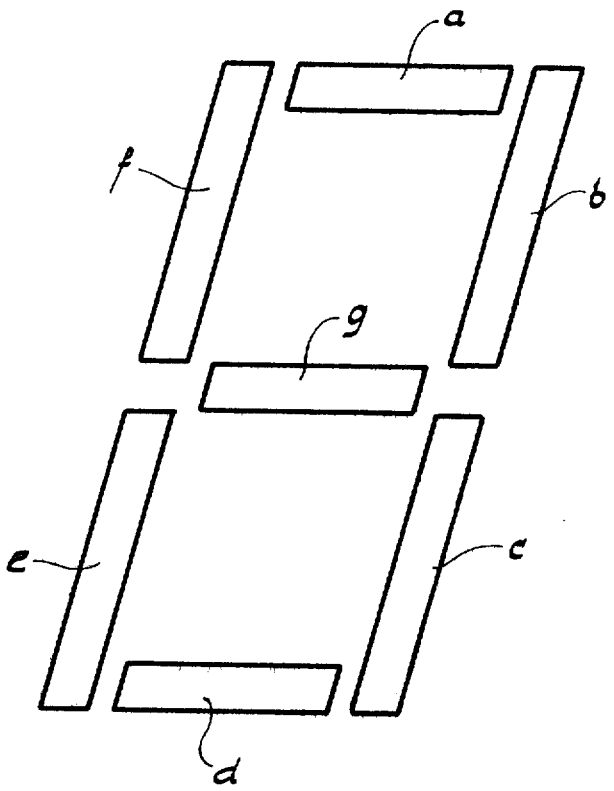
PRIOR ART FIG. 5
FIG. 5 is a plan view of a prior art 7-segment array.

A separate set of switching circuits controls each row of cathodes. Rows one, two and three are controlled by switches 101–104, 201–204 and 301–304, respectively. The buffer width is one cathode. Therefore, the number of switches required for each row equals the sum of the buffer width plus the number of cathodes in each group in that row, which in FIG. 5 is one plus three, which equals four.

The invention also can be applied to display systems whose symbols are arranged in conventional 7-segment arrays. FIG. 5 shows the conventional 7-segment array and the conventional letter designations a–g for the seven electrodes in each array. Since the invention is defined in terms of the positions of electrodes arranged in rows, the seven electrodes must be considered as having positions in a row to apply the invention.

Figure 6:
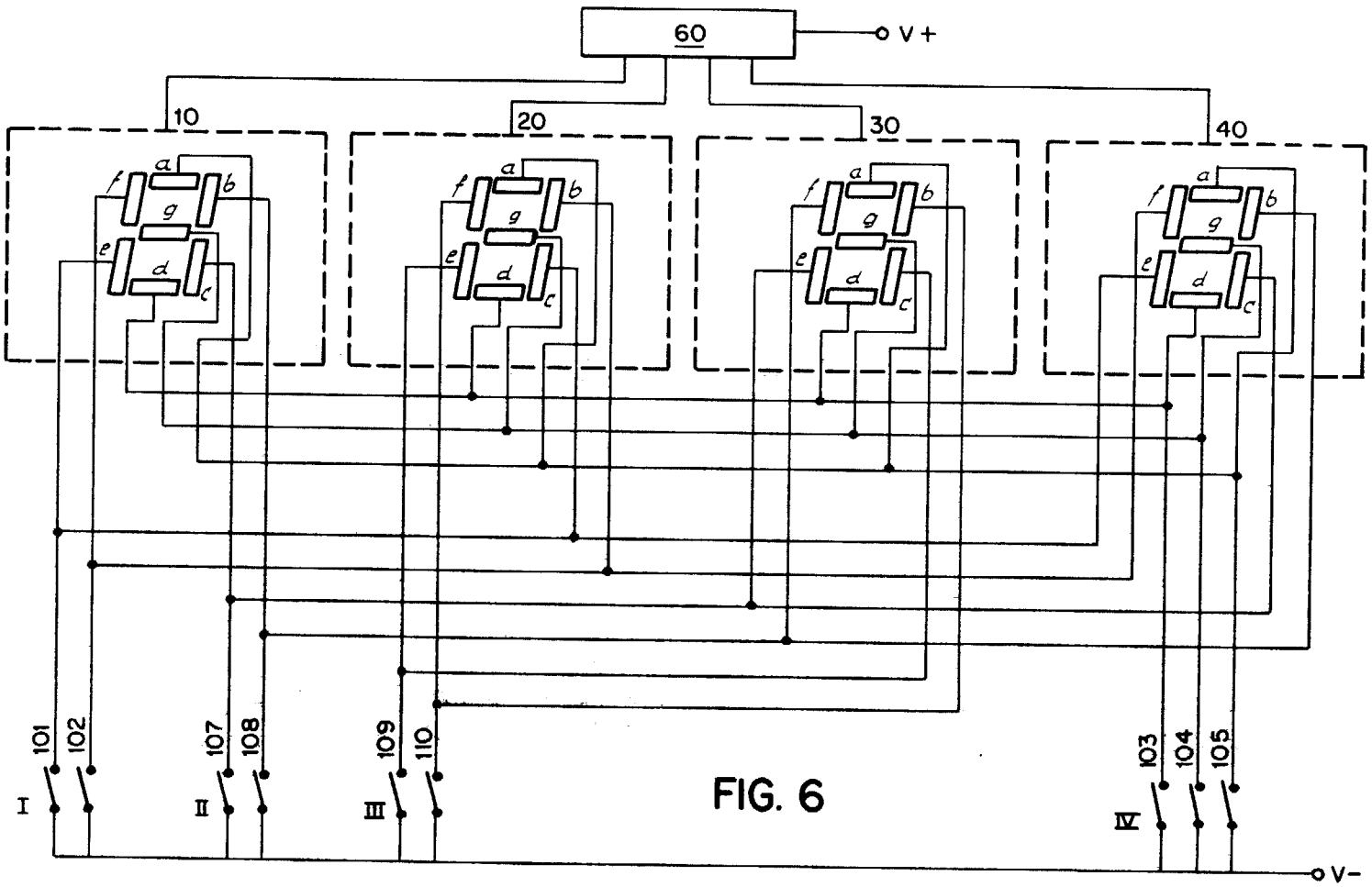
FIG. 6 is a schematic diagram of a display system comprising a row of four 7-segment arrays.

One technique would be to consider the electrodes as arranged in a row in the order e, f, d, g, a, c, b. For example, FIG. 6 shows a display system comprising a row of four 7-segment arrays of electrodes wired in a pattern like that of FIG. 2. As in FIG. 2, the buffer zone width is two electrodes. In each 7-segment array, one buffer zone consists of the first two electrodes "e" and "f," and the other buffer zone consists of the last two electrodes "c" and "b."

In the first 7-segment array in FIG. 6, the e, f, d, g, a, c, and b electrodes are respectively connected like electrodes 11, 12, 13, 14, 15, 17 and 18 in FIG. 2. In the second 7-segment array in FIG. 6, the e, f, d, g, a, c and b electrodes are respectively connected like electrodes 21, 22, 23, 24, 25, 27 and 28 in FIG. 2.

Since the display system shown in FIG. 6 has one less electrode per group than the system shown in FIG. 2 (i.e., it has seven electrodes per group instead of eight), it also has one less switching circuit. In particular, FIG. 6 omits switching circuit 106 and the electrodes connected thereto, which in FIG. 2 are electrodes 16, 26, 36 and 46.

Figure 7:
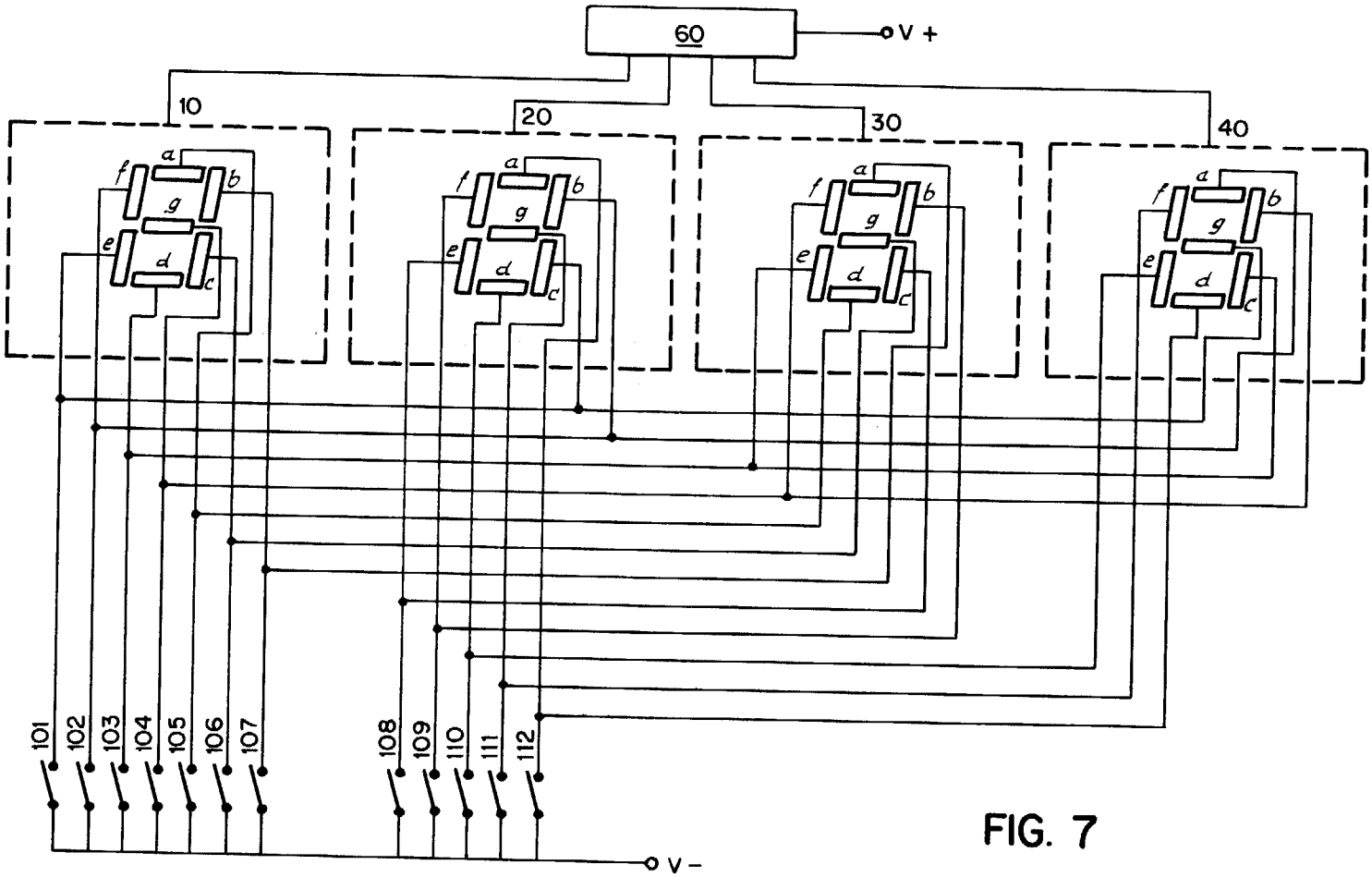
FIG. 7 is a schematic diagram of an alternative embodiment of a display system comprising a row of four 7-segment arrays.

FIG. 7 shows another embodiment having one row of four 7-segment arrays. In this example, the buffer zone width is five electrodes, there are twelve switching circuits 101–112, and the electrodes are wired in a pattern like that of FIG. 3.

Display systems usually include a decoder circuit for determining, as a function of the characters to be displayed, which switching circuits should be "on" or "off" when each electrode group is enabled. The preferred embodiments of the invention use a single-chip micro-computer for this purpose. Other contemplated embodiments may use just a read-only memory circuit instead of a complete micro-computer.

The specification, including the claims, frequently refers to the arrangement of electrodes in a "row." Although the Figures illustrate horizontal rows, a "row" of electrodes is to be interpreted as a substantially linear arrangement of electrodes either horizontally, vertically or at any other angle.

The specification, including the claims, also refers to the "first" or "last" electrode in a group, and to the "first" or "last" group in a row. This is to be interpreted as the electrode (or group) at one end or the other of a group (or row), and this one end or the other may be at the left, right, top or bottom. The Figures illustrate the first and last electrodes as the leftmost and rightmost, respectively, but these terms are not to be so limited.

What is claimed is:

1. A display apparatus for selectively displaying a plurality of symbols, comprising a plurality of consecutively positioned electrodes, each electrode being associated with a separate symbol, the electrodes being divided into a plurality of electrode groups, and the electrode groups being disposed in a row;

means for selectively enabling each electrode group so that each symbol is displayed if an activating signal is applied to the electrode associated with that symbol while the group containing that electrode is enabled; and a plurality of switching circuits, the number of switching circuits being less than the number of electrodes, wherein each switching circuit connects to at least one electrode and controllably alternates between an on state wherein it applies the activating signal to all the electrodes to which it connects and an off state wherein it does not apply the activating signal to any of the electrodes to which it connects, wherein in each electrode group, except for the first group in the row, the electrode in that group closest to the preceding group in the row connects to one of the switching circuits other than those connected to the electrodes in the preceding group.

2. A display apparatus according to claim 1, wherein in each electrode group, except for the first group in the row, the first two or more consecutive electrodes in that group connect to switching circuits other than the switching circuits connected to the electrodes in the preceding group in the row, said preceding group being the group adjacent to said first two or more consecutive electrodes.

3. A display apparatus according to claim 1, wherein the first N consecutive electrodes in each electrode group, except for the first group in the row, are connected to switching circuits other than the switching circuits connected to the electrodes in the preceding group in the row, said preceding group being the group adjacent to said first N consecutive electrodes, N being an integer greater than or equal to one.

4. A display apparatus according to claim 1, wherein the total number of switching circuits is a number M;

the first of the M switching circuits connects to the first electrode and every M-th consecutively positioned electrode thereafter;

the second of the M switching circuits connects to the second electrode and every M-th consecutively positioned electrode thereafter;

the third of the M switching circuits connects to the third electrode and every M-th consecutively positioned electrode thereafter; and each of the other of the M switching circuits is successively connected to the other electrodes in a like pattern.

5. A display apparatus according to claim 1, wherein the switching circuits are divided into four mutually exclusive sets of switching circuits, the first, second and third sets each consisting of N distinct switching circuits, the fourth set consisting of all the remaining switching circuits, and N being a positive integer;

the switching circuits in the first set connect to the first N electrodes in the first group and every third group thereafter in the row, and also connect to the last N electrodes in the second group and every third group thereafter in the row;

the switching circuits in the second set connect to the last N electrodes in the first group and every third group thereafter in the row, and also connect to the first N electrodes in the third group and every third group thereafter in the row;

the switching circuits in the third set connect to the first N electrodes in the second group and every third group thereafter in the row, and also connect to the last N electrodes in the third group and every third group thereafter in the row; and the switching circuits in the fourth set connect to the electrodes other than the first N and last N electrodes in each group.

6. A display apparatus for selectively displaying a plurality of symbols, comprising a plurality of consecutively positioned electrodes, each electrode being associated with a separate symbol, the electrodes being divided into a plurality of electrode groups, and the electrode groups being disposed in a row;

means for selectively enabling each electrode group so that each symbol is displayed if and only if an activating signal is applied to the electrode associated with that symbol while the group containing that electrode is enabled; and a plurality of switching circuits, the number of switching circuits being less than the number of electrodes, wherein each switching circuit connects to at least one electrode and controllably alternates between an on state wherein it applies the activating signal to all the electrodes to which it connects and an off state wherein it does not apply the activating signal to any of the electrodes to which it connects, wherein in each electrode group, except for the last group in the row, the electrode in that group closest to the next succeeding group in the row connects to one of the switching circuits other than those connected to the electrodes in the next succeeding group.

7. A display apparatus according to claim 6, wherein in each electrode group, except for the last group in the row, the last two or more consecutive electrodes in that group connect to switching circuits other than the switching circuits connected to the electrodes in the next succeeding group in the row, said next succeeding group being the group adjacent to said last two or more consecutive electrodes.

8. A display apparatus according to claim 6, wherein the last N consecutive electrodes in each electrode group, except for the last group in the row, are connected to switching circuits other than the switching circuits connected to the electrodes in the next succeeding group in the row, said next succeeding group being the group adjacent to said last N consecutive electrodes, N being an integer greater than or equal to one.

9. A display apparatus according to claim 6, wherein in each electrode group, except for the first group in the row, the electrode in that group closest to the preceding group in the row connects to one of the switching circuits other than those connected to the electrodes in the preceding group.

10. A display apparatus according to claim 9, wherein in each electrode group, except for the first group in the row, the first two or more consecutive electrodes in that group connect to switching circuits other than the switching circuits connected to the electrodes in the preceding group in the row, said preceding group being the group adjacent to said first two or more consecutive electrodes; and in each group, except for the last group in the row, the last two or more consecutive electrodes in that group connect to switching circuits other than the switching circuits connected to the electrodes in the next succeeding group in the row, said next succeeding group being the group adjacent to said last two or more consecutive electrodes.

11. A display apparatus according to claim 9, wherein the first N consecutive electrodes in each electrode group, except for the first group in the row, are connected to switching circuits other than the switching circuits connected to the electrodes in the preceding group in the row, said preceding group being the group adjacent to said first N consecutive electrodes; and the last N consecutive electrodes in each electrode group, except for the last group in the row, are connected to switching circuits other than the switching circuits connected to the electrodes in the next succeeding group in the row, said next succeeding group being the group adjacent to said last N consecutive electrodes;

N being an integer greater than or equal to one.

12. A display apparatus according to claim 3, 8 or 11 wherein the integer N is large enough to prevent the proximity of any electrode to any enabled group from causing an erroneous display.

13. A display apparatus according to claim 1, 2, 3, 6, 7, 8, 9, 10 or 11, wherein each switching circuit connects to at most one electrode in each group.

14. A display apparatus according to claim 13, further comprising means for selectively enabling at most one electrode group at any moment in time.

15. A display apparatus according to claim 1 comprising a gas discharge display tube, wherein each of the electrodes is a cathode within the display tube, and wherein the means for selectively enabling each electrode group comprises a plurality of anodes within the display tube, each electrode group consisting of the cathodes associated with a single anode.

16. A display apparatus according to claim 1 comprising a vacuum fluorescent display tube, wherein each of the electrodes is an anode within the display tube, and wherein the means for selectively enabling each electrode group comprises a plurality of grids within the display tube, each electrode group consisting of the anodes associated with a single grid.

* * * * *